US005755366A

United States Patent [19]

Mazzo

[11] Patent Number: 5,755,366

[45] Date of Patent: May 26, 1998

[54] WRIST AND LEG WALLET

[76] Inventor: Charles Mazzo, 10 Lachlan St., Liverpool NSW, Australia, 2170

[21] Appl. No.: 827,181

[22] Filed: Mar. 27, 1997

[51] Int. Cl.[6] ..... A45F 3/14

[52] U.S. Cl. ..... 224/222; 224/236; 224/267; 224/901.6; 383/86; 150/131

[58] Field of Search ..... 224/191, 219, 224/220, 221, 222, 235, 236, 267, 901, 901.2, 901.4, 901.6; 150/131, 132, 138; 383/86, 88; 206/811

[56] References Cited

U.S. PATENT DOCUMENTS

| | | | |
|---|---|---|---|
| D. 323,939 | 2/1992 | Mok | 224/221 |
| 1,686,756 | 10/1928 | Lorber | 150/132 |
| 2,015,199 | 9/1935 | Sparks et al. | 383/86 |
| 4,421,150 | 12/1983 | Masters | 383/86 |
| 4,638,912 | 1/1987 | Graf | 383/86 |
| 4,905,881 | 3/1990 | Graber | 224/267 |
| 4,913,326 | 4/1990 | Echelson | 224/267 |
| 5,009,347 | 4/1991 | Phelps | 224/219 |
| 5,588,571 | 12/1996 | Mazzo | 224/267 |

*Primary Examiner*—Henry J. Recla
*Assistant Examiner*—Gregory Vidovich

[57] ABSTRACT

A waterproof wallet and pouch combination can be securely worn around the wrist, with the wallet (1) secured in the pouch (9) in a substantially waterproof manner. The pouch (9) is secured to the limb (30) by means of a sleeve (27) and is secured in position by hook and loop type fasteners (24 & 29, 23 & 21, and 19 & 21). When the back (11) of the pouch (9) seals over the opening (12) in the pouch (9) to secure to the front (10) of the pouch (9) by hook and loop type fasteners (15 & 16) the section (17) of the front (10) of the pouch adjacent the opening (12) of the pouch folds back on its self. The wallet (1) contains a note compartment (2) which runs the length of the wallet (1), and is divided into three sections (6,7 & 3) along its length and is folded with, at least, one of the end sections (6) being folded onto the middle section (7), and placed in the pouch (9).

9 Claims, 5 Drawing Sheets

WRIST AND LEG WALLET

BACKGROUND OF THE INVENTION

The present invention relates to a pouch which is adapted to be worn on the limb of the user, and in particular, to a wallet and a pouch combination which is adapted to be worn on the limb of the user Carrying a conventional wallet can be inconvenient and uncomfortable for people when they are wearing sport attire or clothes without pockets. When wearing such clothes many people resort to carrying a conventional wallet in their hands or place the wallet in a position between their clothes and their body. Under such circumstances the conventional wallet is susceptible to being lost. Another problem is that the wallet can be damaged by sweat or by immersion in water.

SUMMARY OF THE INVENTION

The present invention seeks to ameliorate these disadvantages by providing a waterproof pouch, adapted to be worn around the limb of a user;

wherein said pouch comprises: a front member; and a back member forming a cavity there between, said back member having an extension portion which extends on one side beyond the respective side of said front member and forming an opening into the cavity, along the respective side of said front member;

a flexible panel member connected to said back member to form a sleeve therewith, so as to receive a limb of a user, therethrough;

a first hook and loop type fastener located on the front of said extension portion of said back member;

a second hook and loop type fastener located on the front of said front member adjacent said opening of the pouch; whereby said hook and loop type fasteners releaseably seal to each other, with said extension portion of said back member folded over and sealing said opening, with a portion of said front member between said opening and said second hook and loop type fastener folding back on itself;

a first strap, having a third hook and loop type fastener thereon, extending from one side edge of said extension portion of said back member;

a second strap, having a fourth hook and loop type fastener thereon, extending from the other side edge of said extension portion of said back member;

a fifth hook and loop type fastener located on said panel member adjacent the first and second straps;

a third strap having a sixth hook and loop type fastener thereon extending from one side edge of said pouch remote from said first and said second straps;

a seventh hook and loop type fastener located on said panel member;

whereby, in use, the sleeve is worn on the limb of a user, and the third hook and loop type fastener on said first strap and the fourth hook and loop type fastener on the second strap being adapted to releasably fasten to the fifth hook and loop type fastener on the panel member, and the sixth hook and loop type fastener on the third strap being adapted to releasably fasten onto the seventh hook and loop type fastener on the panel member, to secure the pouch onto the limb of a user.

In another form the invention provides a waterproof wallet and pouch combination, adapted to be worn around the wrist of a user;

wherein said pouch comprises: a front member; and a back member forming a cavity there between, said back member having an extension portion which extends on one side beyond the respective side of said front member and forming an opening into the cavity, along the respective side of said front member;

a flexible panel member connected to said back member to form a sleeve therewith, so as to receive a limb of a user, therethrough;

a first hook and loop type fastener located on the front of said extension portion of said back member;

a second hook and loop type fastener located on the front of said front member adjacent said opening of the pouch; whereby said hook and loop type fasteners releaseably seal to each other, with said extension portion of said back member folded over and sealing said opening, with a portion of said front member between said opening and said second hook and loop type fastener folding back on itself;

a first strap, having a third hook and loop type fastener thereon, extending from one side edge of said extension portion of said back member;

a second strap, having a fourth hook and loop type fastener thereon, extending from the other side edge of said extension portion of said back member;

a fifth hook and loop type fastener located on said panel member adjacent the first and second straps;

a third strap having a sixth hook and loop type fastener thereon extending from one side edge of said pouch remote from said first and said second straps;

a seventh hook and loop type fastener located on said panel member;

whereby, in use, the sleeve is worn on the limb of a user, and the third hook and loop type fastener on said first strap and the fourth hook and loop type fastener on the second strap being adapted to releasably fasten to the fifth hook and loop type fastener on the panel member, and the sixth hook and loop type fastener on the third strap being adapted to releasably fasten onto the seventh hook and loop type fastener on the panel member, to secure the pouch onto the limb of a user;

wherein said cavity is adapted to removably hold said wallet therein, when the wallet is in a folded configuration, and wherein said wallet comprises three substantially equal in length flexible sections, extending along the length of the wallet, said sections being a first end section, a middle section, and a second end section; and said wallet further comprises a first compartment extending along all three sections, and at least a second compartment located on the first end section, whereby the wallet is in its folded configuration when said second end section is folded over the middle section.

BRIEF DESCRIPTION OF THE DRAWINGS

The present invention will now be described by way of example with reference to the accompanying drawings in which.

DETAILED DESCRIPTION OF AN EMBODIMENT

Figure 1:
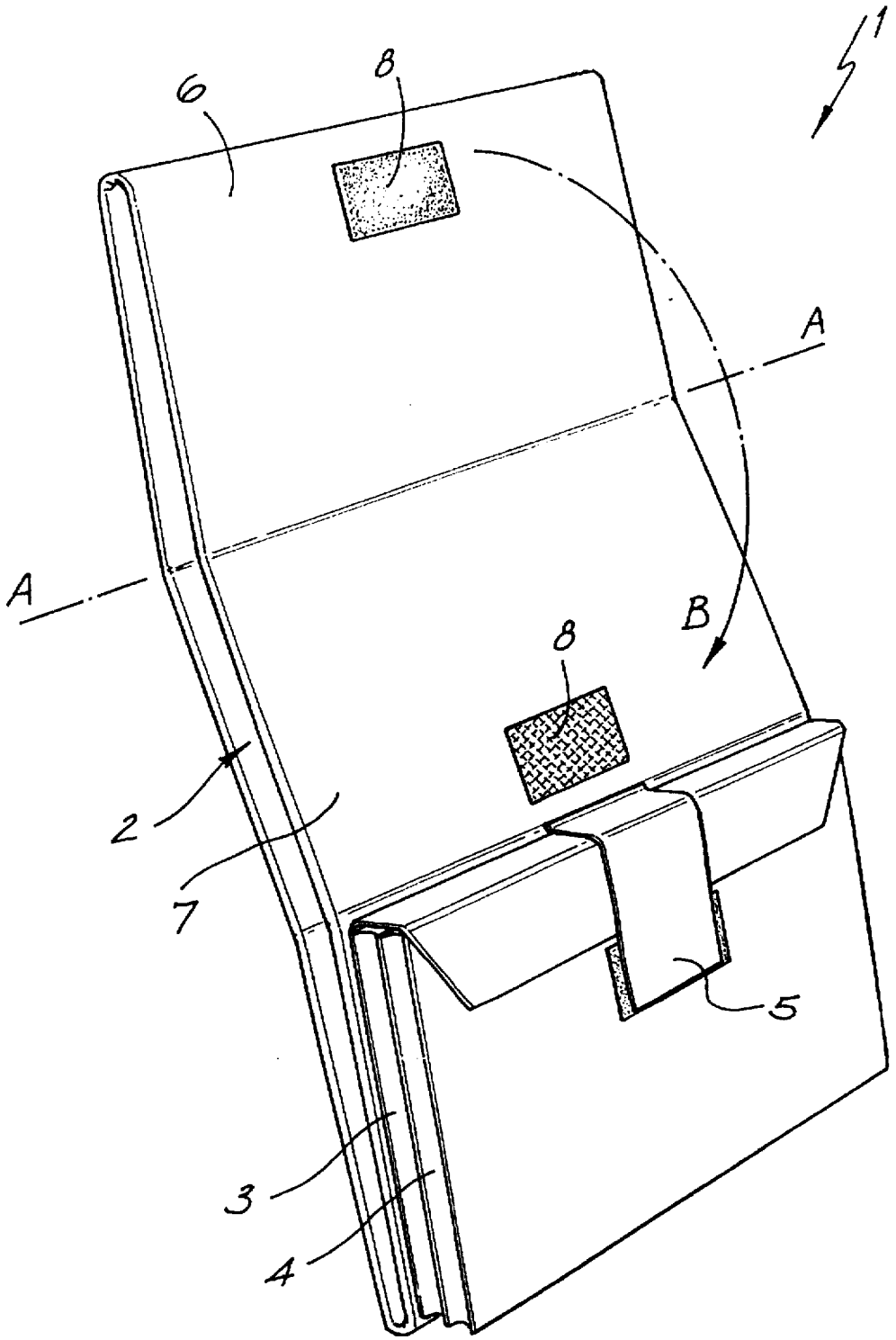
FIG. 1 is a perspective view of one embodiment of a wallet of the present invention in an unfolded condition.

FIG. 1 shows a wallet (1), of an embodiment of the wallet and pouch combination of the present invention, in an unfolded condition. The wallet (1) has a note compartment (2), a credit card compartment (3) and a coin/key compartment (4). The credit card compartment (3) and the coin/key compartment (4) covers one third the length of the wallet (1), and is provided with a strap/cover (5) to ensure that items held therein do not fall out.

The note compartment (2), which runs the length of the wallet (1), has a free end portion (6) which is substantially one third of the length of the wallet (1) and an intermediate portion (7), which is also substantially one third the length of the wallet (1).

The free end portion (6) and the intermediate portion (7) are provided with hook and loop type fastener tabs (8). The wallet (1) is adapted such that the free end portion (6) can be folded substantially about the line A—A in the direction of arrow B onto the intermediate portion (7). The hook and loop type fastener tabs (8) allowing for the free end portion (6), to be attached to and held against the intermediate portion (7) as shown in FIG. 2.

Figure 2:
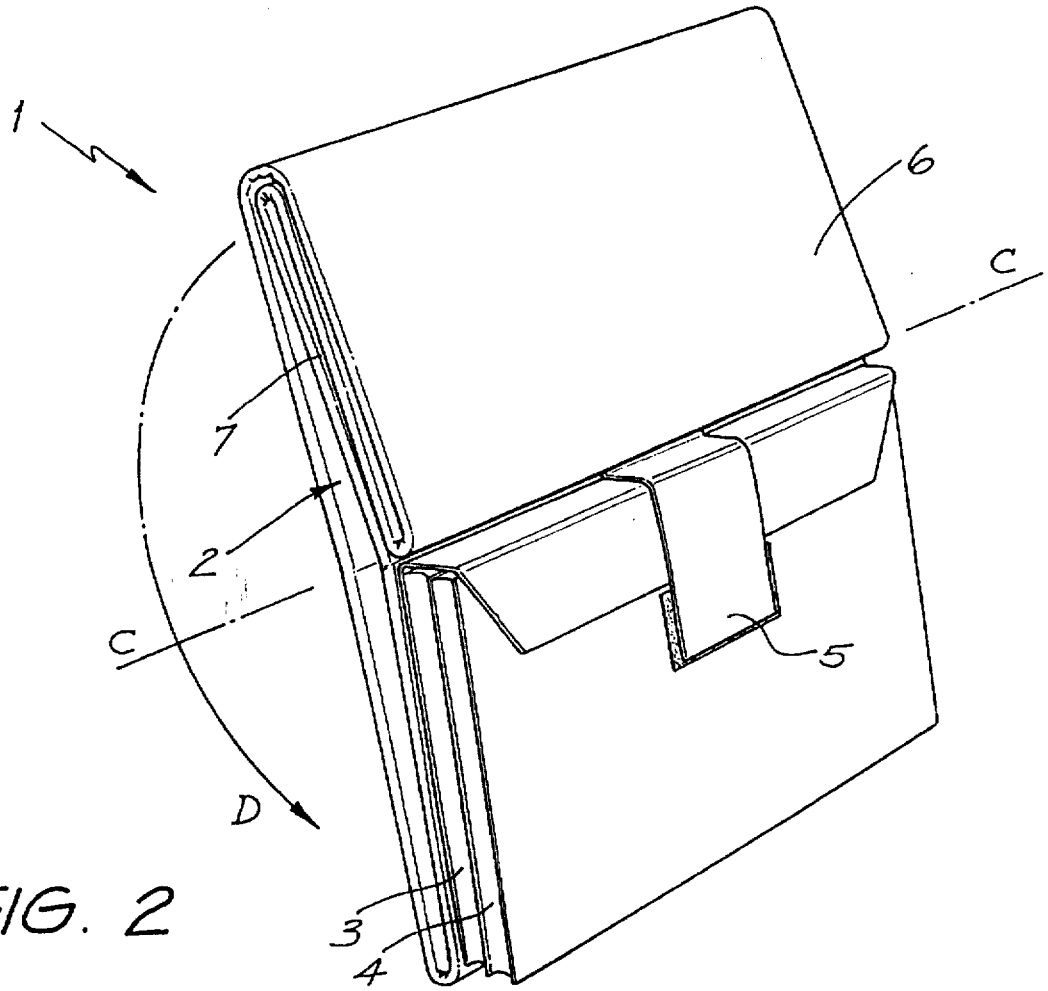
FIG. 2 is a perspective view of the wallet of FIG. 1 in a first folded configuration.
Figure 3:
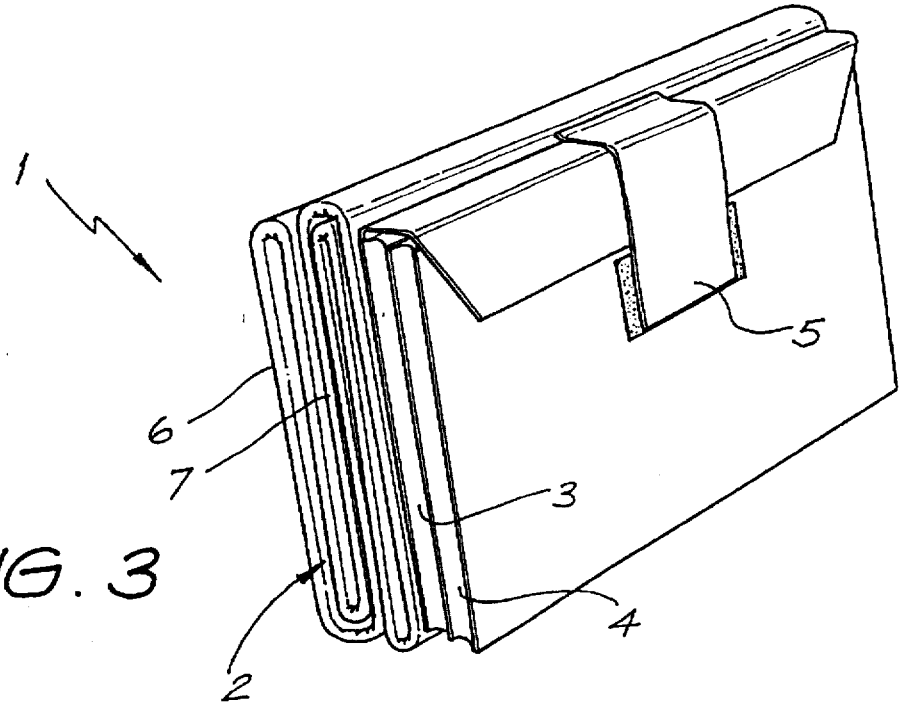
FIG. 3 is a perspective view of the wallet of FIG. 1 in a second folded position.

As shown in FIG. 2, the free end portion (6) and the attached intermediate portion (7) can be further folded about the line C—C in the direction of the arrow D, thereby reducing the wallet (1) to substantially one third its length, as shown in FIG. 3.

Figure 4:
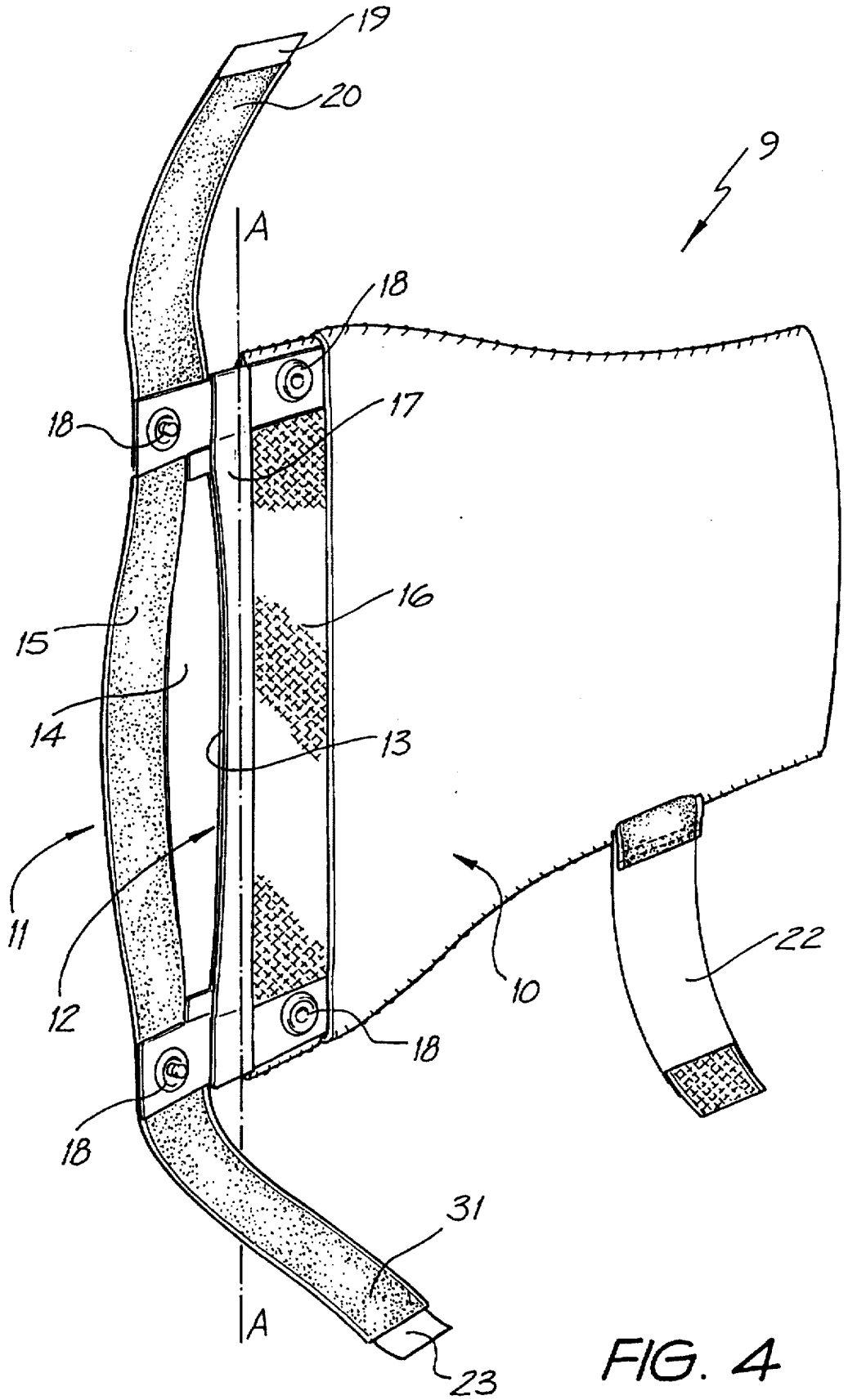
FIG. 4 is a perspective view of a pouch according to an embodiment of the present invention.

One embodiment of a pouch (9) is shown in FIG. 4. The pouch (9) is made from waterproof material, such as neoprene rubber, and has a front member (10) and a back member (11) with an opening (12) formed along one side (13) of the front member (10). The back member (11) has an extension portion (14) which extends beyond the side (13) of the front member (10). Located on the front surface of the extension portion (14) is a hook and loop type fastener strip (15), which fastens onto a receptive hook and loop type fastener strip (16) on the front of the front member (10).

The wallet (1) is placed into the opening (12) and the extension portion (14) is closed over the opening (12) with the two hook and loop type fastener strips (15 & 16) securing the sealing. The edge portion (17) of the front member (10) is folded along fold line A—A, back on the front member (10) beneath the back member (11), to improve the water resistance of the sealing of the opening (12). Additionally, press stud type fasteners (18) can be used to assist in the sealing.

Figure 7:
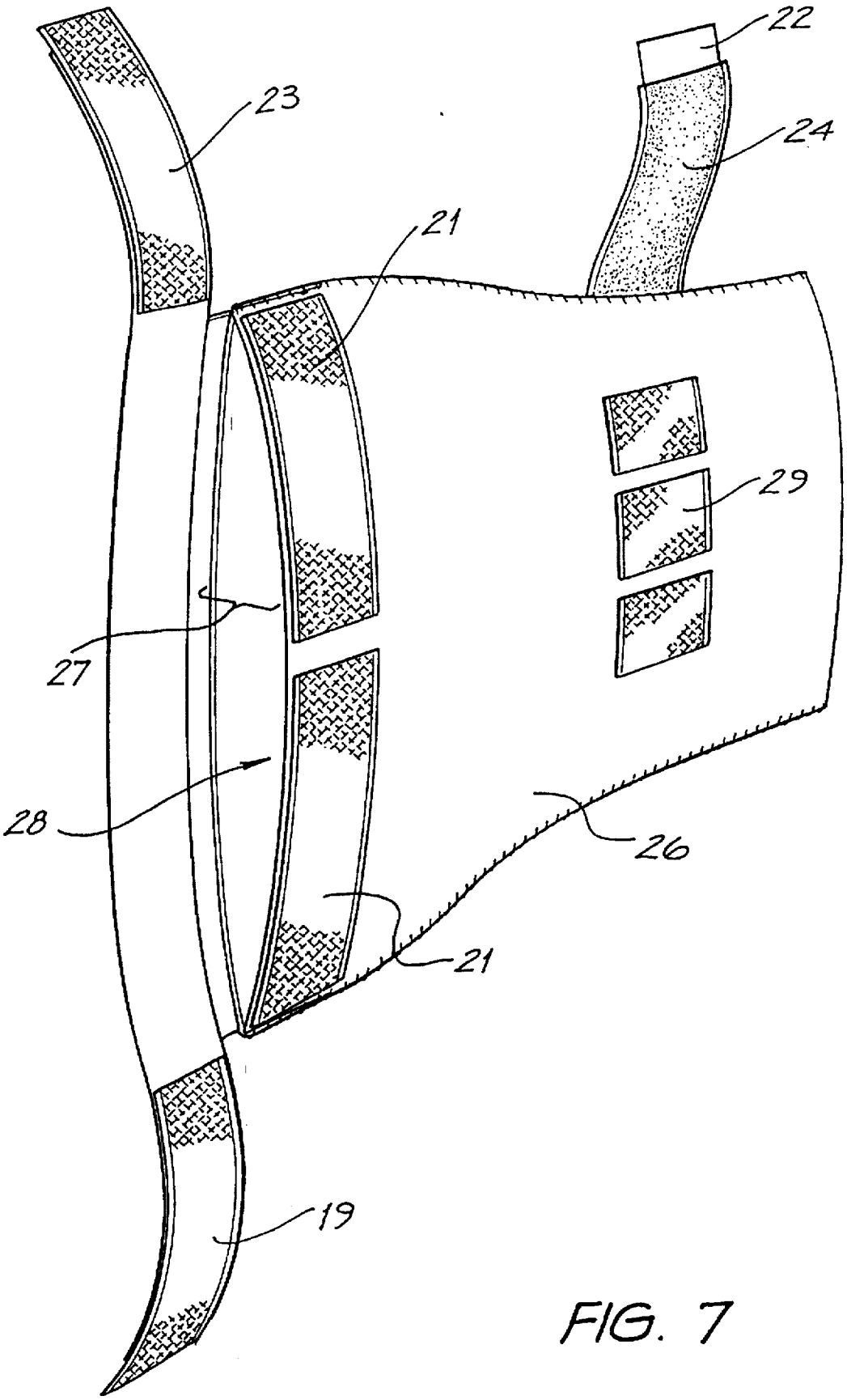
FIG. 7 is a perspective view of the pouch shown in FIG. 4, viewed from the reverse side.

Extending from one side of the extension portion (14) is a strap (19) having a hook and loop type fastener strip (20) and located on the other side of the extension portion (14) is a strap (23) having a hook and loop type fastener strip (31). As shown in FIG. 7, the rear of the pouch comprises a panel (26) of a flexible material, such as Lycra, forming a sleeve (27). Located on the panel (26), adjacent the opening (28) of the sleeve (27) is a receptive hook and loop type fastener strip (21).

Located towards the other end of the pouch (9) is a third strap (22), which is connected only adjacent one end to the side of the front member (10). Because the strap (22) is unattached to the front of the front member (10) there is no interference by the strap (22) of the flexibility of the pouch (9). A hook and loop type fastener (24) is located thereon.

Figure 5:
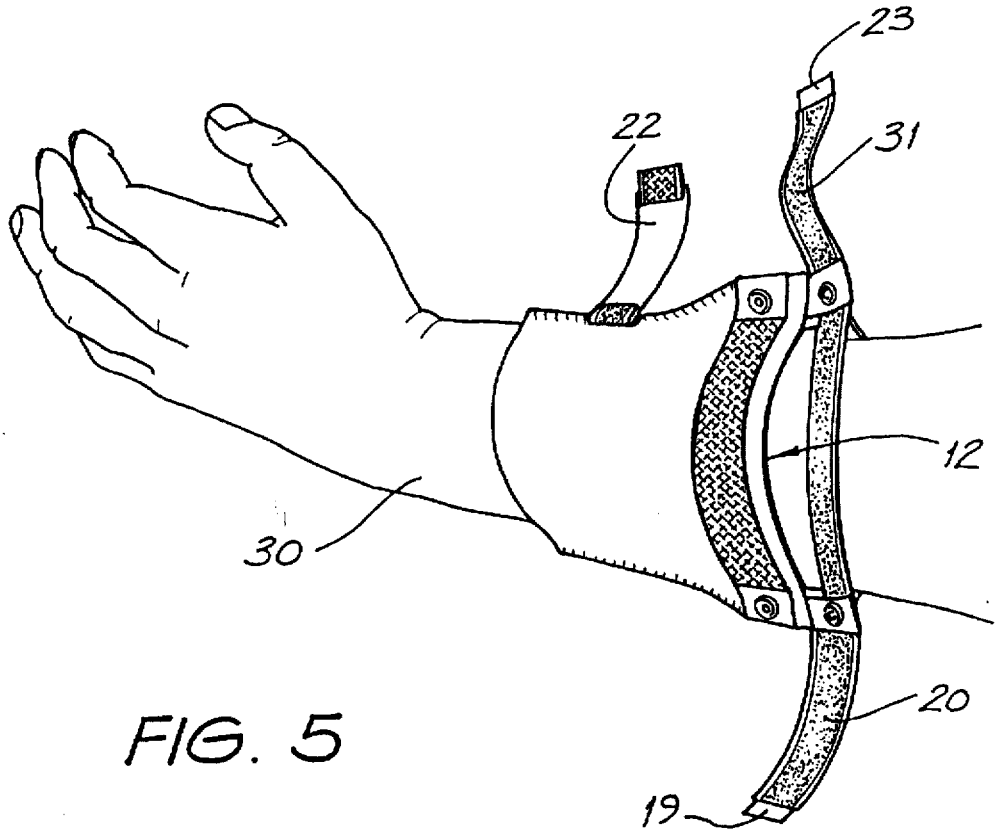
FIG. 5 is perspective view of the pouch of FIG. 4 being secured to the wrist of a user.
Figure 6:
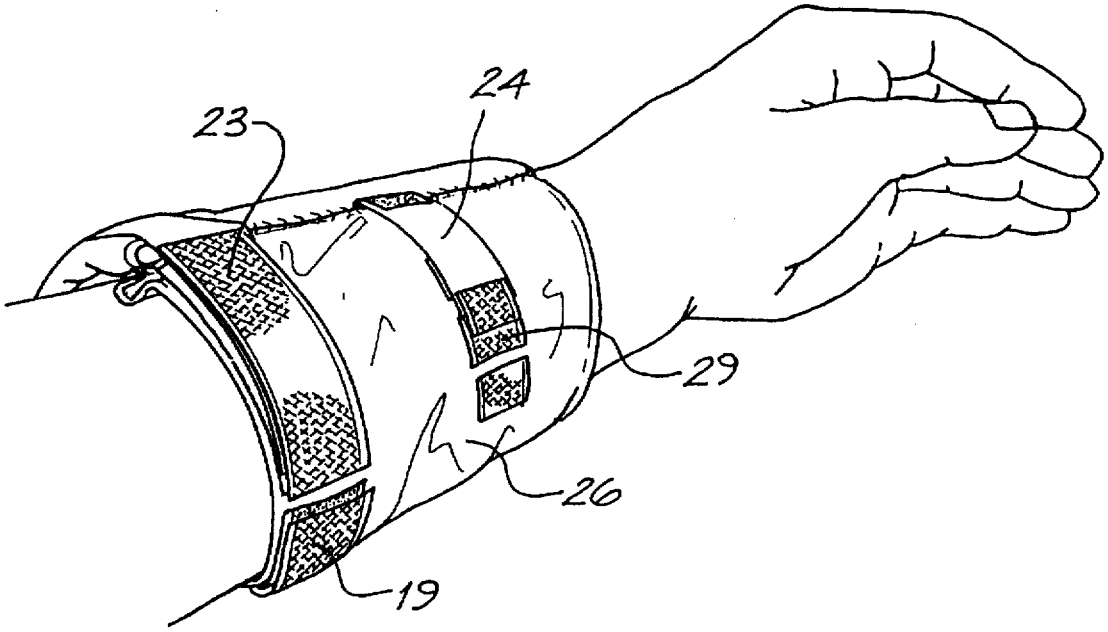
FIG. 6 is a perspective view of the pouch of FIG. 4 fully secured to the wrist of a user.

To secure the pouch (9) to the wrist of a user, as shown in FIGS. 5 & 6, the user pulls the sleeve (27) over his hand until it is positioned against the wrist or lower forearm (30) of the user as shown in FIGS. 5 & 6. The strap (22) is pulled tight and the hook and loop fastener (24) is secured to the receptive hook and eye fastener (29), located on the panel (26), as shown in FIG. 6.

The wallet (1) or other objects can be inserted into the pouch (9) through the opening (12) and the extension portion (14) is closed over the opening (12) with the two hook and loop type fastener strips (15 & 16) securing the sealing. The edge portion (17) of the front member (10) is folded along fold line A-A, back onto the front member (10) beneath the back member (11), to improve the water resistance of the sealing of the opening (12). The press studs (18) are then secured.

The straps (19 & 23) are then pulled to the required tightness around the wrist, and the respective hook and loop fasteners (20 & 31) are affixed to the receptive hook and loop type fastener (21) on the panel (26), as shown in FIG. 6.

It should be obvious to people skilled in the art that modifications and alterations can be made without departing from the spirit or the scope of the present invention.

The invention claimed is:

1. A waterproof pouch, adapted to be worn around the limb of a user;

wherein said pouch comprises: a front member; and a back member forming a cavity there between, said back member having an extension portion which extends on one side beyond a respective side of said front member and forming an opening into the cavity, along the respective side of said front member;

a flexible panel member connected to said back member to form a sleeve therewith, so as to receive a limb of a user, therethrough;

a first hook and loop type fastener located on the front of said extension portion of said back member;

a second hook and loop type fastener located on the front of said front member adjacent said opening of the pouch; whereby said hook and loop type fasteners releaseably seal to each other, with said extension portion of said back member folded over and sealing said opening, with a portion of said front member between said opening and said second hook and loop type fastener folding back on itself;

a first strap, having a third hook and loop type fastener thereon, extending from one side edge of said extension portion of said back member;

a second strap, having a fourth hook and loop type fastener thereon, extending from an other side edge of said extension portion of said back member;

a fifth hook and loop type fastener located on said panel member adjacent the first and second straps;

a third strap having a sixth hook and loop type fastener thereon extending from one side edge of said pouch remote from said first and said second straps;

a seventh hook and loop type fastener located on said panel member;

whereby, in use, the sleeve is worn on the limb of a user, and the third hook and loop type fastener on said first strap and the fourth hook and loop type fastener on the second strap being adapted to releasably fasten to the fifth hook and loop type fastener on the panel member, and the sixth hook and loop type fastener on the third strap being adapted to releasably fasten onto the seventh hook and loop type fastener on the panel member, to secure the pouch onto the limb of a user.

2. A waterproof pouch according to claim 1 further comprising press stud type fasteners located adjacent said first and second hook and loop type fasteners.

3. A waterproof pouch according to claims 1, wherein said panel member is made from a stretchable material.

4. A waterproof pouch according to claim 1, wherein said back and front members are made of a neoprene rubber.

5. A waterproof wallet and pouch combination, adapted to be worn around the limb of a user, wherein said pouch comprises: a front member; and a back member forming a cavity there between, said back member having an extension portion which extends on one side beyond a respective side of said front member and forming an opening into the cavity, along the respective side of said front member;

a flexible panel member connected to said back member to form a sleeve therewith, so as to receive a limb of a user, therethrough;

a first hook and loop type fastener located on the front of said extension portion of said back member;

a second hook and loop type fastener located on the front of said front member adjacent said opening of the pouch; whereby said hook and loop type fasteners releaseably seal to each other, with said extension portion of said back member folded over and sealing said opening, with a portion of said front member between said opening and said second hook and loop type fastener folding back on itself;

a first strap, having a third hook and loop type fastener thereon, extending from one side edge of said extension portion of said back member;

a second strap, having a fourth hook and loop type fastener thereon, extending from another side edge of said extension portion of said back member;

a fifth hook and loop type fastener located on said panel member adjacent the first and second straps;

a third strap having a sixth hook and loop type fastener thereon extending from one side edge of said pouch remote from said first and said second straps;

a seventh hook and loop type fastener located on said panel member;

whereby, in use, the sleeve is worn on the limb of a user, and the third hook and loop type fastener on said first strap and the fourth hook and loop type fastener on the second strap being adapted to releasably fasten to the fifth hook and loop type fastener on the panel member, and the sixth hook and loop type fastener on the third strap being adapted to releasably fasten onto the seventh hook and loop type fastener on the panel member, to secure the pouch onto the limb of a user;

wherein said cavity is adapted to removably hold said wallet therein, when the wallet is in a folded configuration, and wherein said wallet comprises three substantially equal in length flexible sections, extending along the length of the wallet, said sections being a first end section, a middle section, and a second end section; and said wallet further comprises a first compartment extending along all three sections, and at least a second compartment located on the first end section, whereby the wallet is in its folded configuration when, at least, said second end section is folded over the middle section.

6. A waterproof pouch and wallet according to claim 5 further comprising press stud type fasteners located adjacent said first and second hook and loop type fasteners.

7. A water-proof pouch and wallet combination according to claims 5, wherein said wallet further includes another compartment, located on the first end for holding credit cards.

8. A waterproof pouch and wallet combination according to claim 5, wherein said panel member is made from a stretchable material.

9. A waterproof pouch and wallet combination according to claim 5, wherein said back and front members are made of a neoprene rubber.

* * * * *